US010539373B2

(12) United States Patent
He et al.

(10) Patent No.: US 10,539,373 B2
(45) Date of Patent: Jan. 21, 2020

(54) HEAT EXCHANGER

(71) Applicant: SANHUA (HANGZHOU) MICRO CHANNEL HEAT EXCHANGER CO., LTD., Hangzhou (CN)

(72) Inventors: Yan He, Hangzhou (CN); Huazhao Liu, Hangzhou (CN); Qiang Gao, Hangzhou (CN)

(73) Assignee: SANHUA (HANGZHOU) MICRO CHANNEL HEAT EXCHANGER CO., LTD., Hangzhou (CN)

( * ) Notice: Subject to any disclaimer, the term of this patent is extended or adjusted under 35 U.S.C. 154(b) by 474 days.

(21) Appl. No.: 14/914,489

(22) PCT Filed: Jan. 16, 2014

(86) PCT No.: PCT/CN2014/070732
§ 371 (c)(1),
(2) Date: Feb. 25, 2016

(87) PCT Pub. No.: WO2015/027680
PCT Pub. Date: Mar. 5, 2015

(65) Prior Publication Data

US 2016/0216047 A1 Jul. 28, 2016

(30) Foreign Application Priority Data

Aug. 28, 2013 (CN) ..... 2013 1 0381531

(51) Int. Cl.
*F28F 1/12* (2006.01)
*F28D 1/047* (2006.01)
(Continued)

(52) U.S. Cl.
CPC ..... *F28F 1/126* (2013.01); *B21D 53/085* (2013.01); *F28D 1/0471* (2013.01);
(Continued)

(58) Field of Classification Search
CPC ... F28F 1/126; F28F 2215/04; F28D 1/05366; F28D 2001/0273; B21D 53/085
(Continued)

(56) References Cited

U.S. PATENT DOCUMENTS 2,063,757 A * 12/1936 Saunders ..... F28D 1/0316 165/152
4,660,624 A * 4/1987 Yamaguchi ..... F28D 1/05366 165/41
(Continued)

FOREIGN PATENT DOCUMENTS

CN 1598467 A 3/2005
CN 101782337 A 7/2010
(Continued)

OTHER PUBLICATIONS

International Search Report and Written Opinion of the International Searching Authority for International Application No. PCT/CN2014/070732 dated May 28, 2014.
(Continued)

*Primary Examiner* — Leonard R Leo
(74) *Attorney, Agent, or Firm* — Howard & Howard Attorneys PLLC

(57) ABSTRACT

A heat exchanger including a first header and a second header; a plurality of flat pipes, each defining a first end connected with the first header and a second end connected with the second header. The plurality of flat pipes are arranged and spaced apart from each other in axial directions of the first and second headers. Each of a plurality of fins is disposed between adjacent flat pipes. The plurality of fins includes first to third fins, in which the heat exchanger has a bending segment and a straight segment adjacent to the bending segment. The first fin is in the straight segment, the second and third fins are in the bending segment, a width of the second fin is larger than a width of the third fin, and the
(Continued)

second and third fins are alternately arranged in the axial directions.

6 Claims, 5 Drawing Sheets

(51) Int. Cl.
*F28D 1/053* (2006.01)
*B21D 53/08* (2006.01)
*F28D 1/02* (2006.01)

(52) U.S. Cl.
CPC .. *F28D 1/05366* (2013.01); *F28D 2001/0273* (2013.01); *F28F 2215/04* (2013.01)

(58) Field of Classification Search
USPC ..... 165/152, 153
See application file for complete search history.

(56) References Cited

U.S. PATENT DOCUMENTS

| | | | | |
|---|---|---|---|---|
| 7,699,095 | B2 * | 4/2010 | Beamer | F28D 1/05366 165/151 |
| 2010/0181058 | A1 | 7/2010 | Huazhao et al. | |
| 2016/0216047 | A1 | 7/2016 | He et al. | |

FOREIGN PATENT DOCUMENTS

| | | | |
|---|---|---|---|
| CN | 201652995 | U | 11/2010 |
| CN | 101949653 | A | 1/2011 |
| CN | 103411446 | A | 11/2013 |
| EP | 1962040 | B1 | 3/2010 |
| JP | H4136690 | A | 5/1992 |
| JP | 2002243381 | A | 8/2002 |
| JP | 200590760 | A | 4/2005 |
| JP | 2005090806 | A | 4/2005 |

OTHER PUBLICATIONS

First Office Action dated Oct. 31, 2014 issued by the State Intellectual Property Office of the People's Republic of China for Chinese Application No. 201310381531.5.

Second Office Action dated May 11, 2015 issued by the State Intellectual Property Office of the People's Republic of China for Chinese Application No. 201310381531.5.

Third Office Action dated Oct. 16, 2015 issued by the State Intellectual Property Office of the People's Republic of China for Chinese Application No. 201310381531.5.

Notification of Reasons for Refusal issued by the Japanese Patent Office for Japanese Application No. 2016-537088 dated Dec. 6, 2016.

* cited by examiner

HEAT EXCHANGER

CROSS-REFERENCE TO RELATED APPLICATIONS

This application claims priority under 35 U.S.C 371 to, and is a U.S. National Phase application of, the International Patent Application No. PCT/CN2014/070732, filed Jan. 16, 2014, which claims the benefit of prior Chinese Application No. 201310381531.5 filed Aug. 28, 2013. The entire contents of the before-mentioned patent applications are incorporated by reference as part of the disclosure of this application.

BACKGROUND OF THE INVENTION

1. Field of the Invention

The present disclosure relates to a heat exchanger, and more particularly to a parallel flow heat exchanger.

2. Description of the Related Art

In the related art, in order to avoid an adverse effect caused by bending on the heat exchanging performance, a variety of measures are taken at a bending region of a heat exchanger bent and molded along a header, such as a micro-channel heat exchanger. For example, the bending region is not provided with a flat pipe and a fin, but a baffle plate for covering, or the bending region is provided with flat pipes, between which a profile is disposed for supporting and connection, or in the bending region, only one side of the fin is welded to the flat pipe.

However, there are still some problems in the above measures. The heat exchanger using the baffle plate in the bending region has neither a supporting structure nor a heat exchanging fin in the bending region when bent, such that the heat exchanger has a poor structure stability, and the heat exchanging performance thereof is decreased; disposing the profile between the flat pipes for supporting and connection increases a wind resistance, and the number of the fins for heat exchanging is reduced, thus affecting an overall heat exchanging performance of the product; welding only one side of the fin to the flat pipe causes a part of the flat pipes within the bending region cannot effectively use the fins for heat exchanging, and this part of the flat pipes can neither get support in strength nor get protection in corrosion from the fins, because this part of the flat pipes are not connected with the fins, thus reducing a life of the heat exchanger; in addition, reducing a width of the fin within the bending region leads to a split at a bent outer side of the fin and a large compression deformation at a bent inner side of the fin.

SUMMARY OF THE INVENTION

Embodiments of the present disclosure seek to solve at least one of the problems existing in the related art to at least some extent. Thus, one objective of the present disclosure is to provide a heat exchanger which can reduce a split and a compression deformation of a fin when bent, thus reducing an influence of the bending on a performance of the heat exchanger.

A heat exchanger according to embodiments of a first aspect of the present disclosure includes a first header and a second header, each of a plurality of flat pipes defining a first end connected with the first header and a second end connected with the second header. The plurality of flat pipes are arranged and spaced apart from each other in axial directions of the first header and the second header. Each of a plurality of fins are disposed between adjacent flat pipes.

The plurality of fins includes a first fin, a second fin and a third fin, in which the heat exchanger has a bending segment and a straight segment adjacent to the bending segment. A first fin is in the straight segment. The second fin and the third fin are in the bending segment. A width of the second fin is larger than a width of the third fin, and the second fin and the third fin are alternately arranged in the axial directions.

With the heat exchanger according to embodiments of the present disclosure, through alternately arranging the second fin and the third fin in the axial directions of the first header and the second header, a compression amount at a bent inner side and an elongation amount at a bent outer side of the fin located at the bending segment are both considered, such that the fin is not split at the bent outer side thereof and has a small compression deformation at the bent inner side thereof after the heat exchanger is bent, thus reducing a loss of the heat exchanging performance, and effectively avoiding the split and the serious compression deformation between the fin and the flat pipe when the heat exchanger is bent.

Moreover, the fin is connected between adjacent flat pipes of the whole heat exchanger, thereby improving a heat exchanging effect, and there is no air loss and increased wind resistance, thus improving the performance. And, since the fin is connected between adjacent flat pipes, a probability of the flat pipe to be corroded is greatly reduced.

In some embodiments of the present disclosure, the second fin and the third fin are alternately arranged in at least one of following manners: one second fin is followed by one third fin, two second fins are followed by one third fin, one second fin is followed by two third fins, and two second fins are followed by two third fins.

In some embodiments of the present disclosure, a ratio of a number of the second fins to a number of the third fins is in a range from 1/3 to 3.

In some embodiments of the present disclosure, the width of the second fin is equal to a width of the first fin.

In some embodiments of the present disclosure, centerlines of the first to third fins extending in a thickness direction of the flat pipe coincide with one another in a plane orthogonal to a length direction of the flat pipe.

In some embodiments of the present disclosure, a ratio of a width of the flat pipe to a width of the fin is less than or equal to 2.

In some embodiments of the present disclosure, a ratio of the width of the second fin to a width of the flat pipe is larger than 0.75 and less than or equal to 1, and a ratio of the width of the third fin to the width of the flat pipe is less than or equal to 0.75.

In some embodiments of the present disclosure, a ratio of the width of the third fin to a width of the second fin is larger than or equal to 0.4 and less than 1.

In some embodiments of the present disclosure, a centerline of the second fin extending in a thickness direction of the flat pipe and a centerline of the third fin extending in a thickness direction of the flat pipe are staggered with each other in a plane orthogonal to a length direction of the flat pipe.

A heat exchanger according to embodiments of a second aspect of the present disclosure includes a first header, a second header, and a plurality of flat pipes. Each of the plurality of flat pipes defines a first end connected with the first header and a second end connected with the second header. The plurality of flat pipes are arranged and spaced apart from each other in an axial direction of the first header and second header. Each of a plurality of fins is disposed between adjacent flat pipes. The plurality of fins includes a first fin, a second fin and a third fin. The heat exchanger has a bending segment and a straight segment adjacent to the bending segment. The first fin is in the straight segment, the second fin and the third fin are in the bending segment. A centerline of the second fin extends in a thickness direction of the flat pipe and a centerline of the third fin extends in the thickness direction of the flat pipe such that they are staggered with each other in a plane orthogonal to a length direction of the flat pipe.

In some embodiments of the present disclosure, the second fin and the third fin are alternately arranged in at least one of following manners: one second fin is followed by one third fin, two second fins are followed by one third fin, one second fin is followed by two third fins, and two second fins are followed by two third fins.

In some embodiments of the present disclosure, widths of the second fin and the third fin are different from each other.

In some embodiments of the present disclosure, a ratio of a number of the second fins to a number of the third fins is in a range from 1/3 to 3.

In some embodiments of the present disclosure, a ratio of a width of the flat pipe to a width of the fin is larger than 2.

With the heat exchanger according to embodiments of the present disclosure, through alternately arranging the second fin and the third fin which are in the bending segment and have different widths in the axial directions of the first header and the second header, or in a width direction of the flat pipe, staggering the centerline of the second fin in the thickness direction of the flat pipe with the centerline of the third fin in the thickness direction of the flat pipe, the compression amount at the bent inner side and the elongation amount at the bent outer side of the fin located at the bending segment are both considered, such that the fin is not split at the bent outer side thereof and has a small compression deformation at the bent inner side thereof after the heat exchanger is bent, thus reducing the loss of the heat exchanging performance, and effectively avoiding the split and the serious compression deformation between the fin and flat pipe when the heat exchanger is bent.

Moreover, the fin is connected between adjacent flat pipes of the whole heat exchanger, thereby improving a heat exchanging effect, and there is no air loss and increased wind resistance, thus improving the performance. And, since the fin is connected between adjacent flat pipes, a probability of the flat pipe to be corroded is greatly reduced.

BRIEF DESCRIPTION OF THE DRAWINGS

Other advantages of the invention will be readily appreciated as the same becomes better understood by reference to the following detailed description when considered in connection with the accompanying drawings, wherein.

Figure 1:
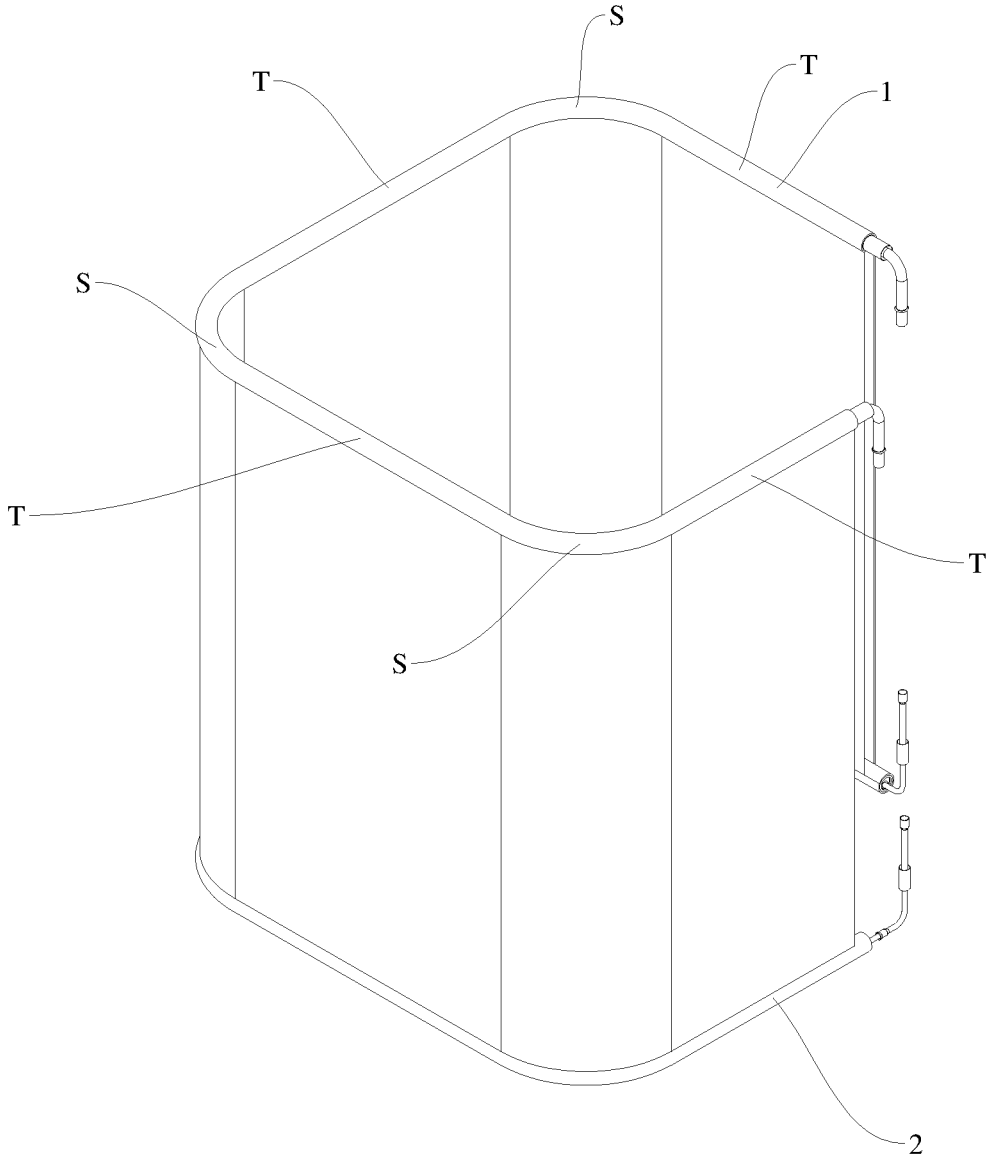
FIG. 1 is a schematic view of a heat exchanger according to an embodiment of the present disclosure.

REFERENCE NUMERALS first header 1; second header 2; flat pipe 3; fin 4; first fin 41; second fin 42; third fin 43; bending segment S; straight segment T; length direction X of the heat exchanger (thickness direction of the flat pipe); height direction Y of the heat exchanger; thickness direction Z of the heat exchanger (width directions of the flat pipe and the fin); width H1 of the second fin; width H2 of the third fin.

DETAILED DESCRIPTION OF THE INVENTION

Reference will be made in detail to embodiments of the present disclosure. Embodiments of the present disclosure will be shown in drawings, in which the same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

In the following, a heat exchanger according to an embodiment of the present disclosure will be described with reference to drawings. As shown in FIGS. 1-4. The heat exchanger according to embodiments of the present disclosure includes: a first header 1, a second header 2, a plurality of flat pipes 3 and a plurality of fins 4.

A first end (an upper end in FIG. 1 and FIG. 2) of the flat pipe 3 is connected with the first header 1, and a second end (a lower end in FIG. 1 and FIG. 2) of the flat pipe 3 is connected with the second header 2, so as to communicate the first header 1 with the second header 2. Each of the plurality of fins 4 is disposed between adjacent flat pipes 3.

The first header 1 and the second header 2 substantially parallelly extend in a length direction X of the heat exchanger (i.e. a thickness direction of the flat pipe, axial directions of the first header 1 and the second header 2) and are spaced apart from each other, and the plurality of flat pipes 3 are arranged and spaced apart from each other in the direction X. Each flat pipe 3 extends in a height direction Y of the heat exchanger (i.e. a length direction of the flat pipe). In other words, the length direction of the flat pipe 3 coincides with the height direction Y of the heat exchanger, the thickness direction of the flat pipe 3 coincides with the length direction of the heat exchanger as well as the axial directions of the first header 1 and the second header 2, and a width direction of the flat pipe 3 and a width direction of the fin 4 coincide with a thickness direction Z of the heat exchanger.

Figure 2:
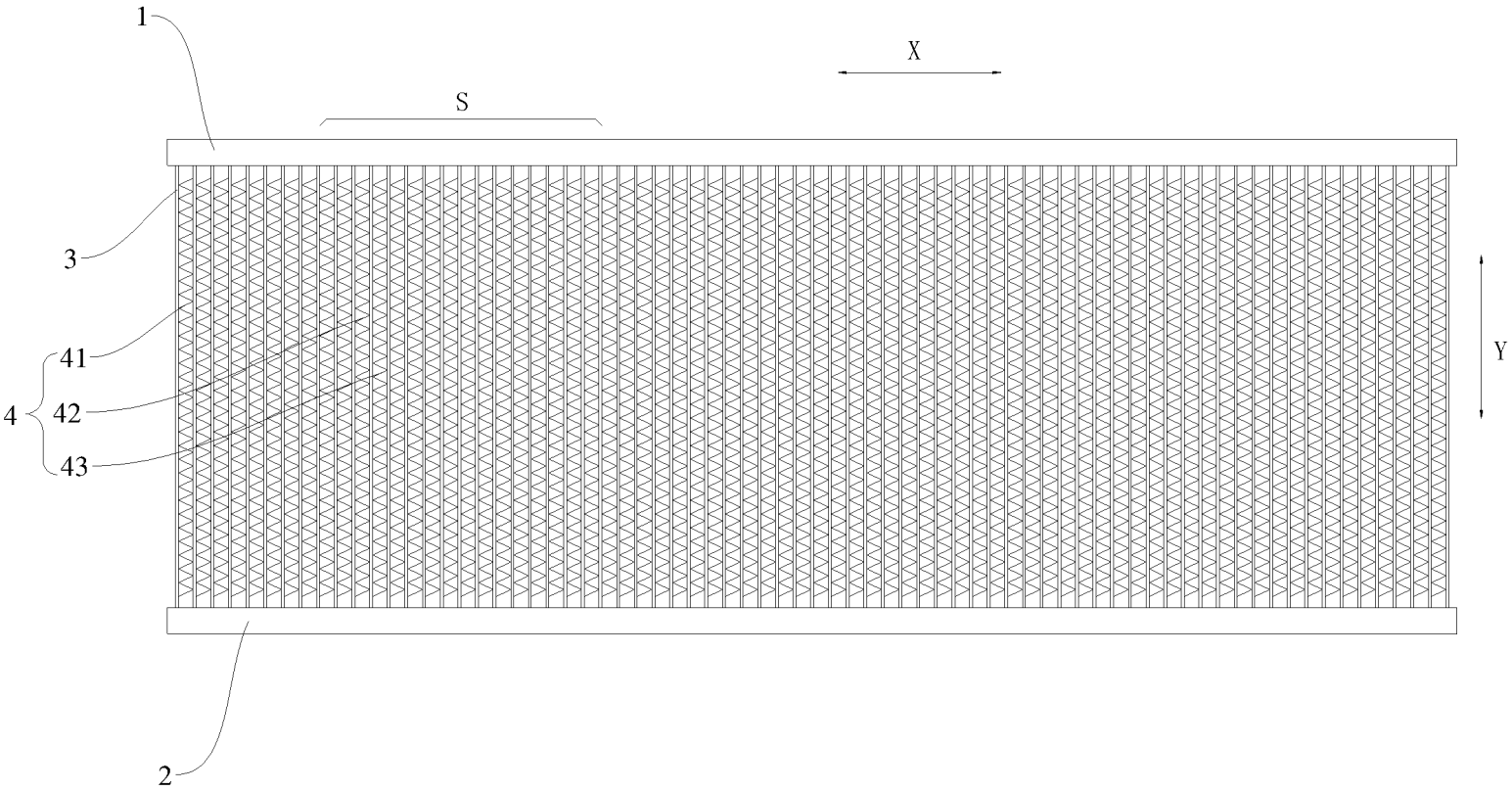
FIG. 2 is a schematic view of a heat exchanger according to an embodiment of the present disclosure, in which the heat exchanger is not bended.

As shown in FIG. 1 and FIG. 2, the heat exchanger has a bending segment S and a straight segment T adjacent to the bending segment S, and the plurality of fins 4 includes a first fin 41, a second fin 42 and a third fin 43. The first fin 41 is in the straight segment T, the second fin 42 and the third fin 43 are in the bending segment S, a width H1 of the second fin 42 is larger than a width of the third fin 43, and the second fin 42 and the third fin 43 are alternately arranged in the direction X.

In an embodiment shown in FIG. 1, the heat exchanger has three bending segments S and four straight segments T, which will not be construed to limit the present disclosure, and the heat exchanger may have any suitable number of the bending segments S according to an application.

With the heat exchanger according to an embodiment of the present disclosure, through alternately arranging the second fin 42 and the third fin 43 which are in the bending segment and have different widths in the axial directions of the first header 1 and the second header 2, a compression amount at a bent inner side and an elongation amount at a bent outer side of the fin located at the bending segment are both considered at the same time, such that the fin is not split at the bent outer side thereof and has a small compression deformation at the bent inner side thereof after the heat exchanger is bent, thus reducing the loss of the heat exchanging performance, and effectively avoiding the split and the serious compression deformation between the fin and flat pipe when the heat exchanger is bent.

Moreover, the fin is connected between adjacent flat pipes of the whole heat exchanger, thereby improving a heat exchanging effect, and there is no air loss and increased wind resistance, thus improving the performance. And, since the fin is connected between adjacent flat pipes, a probability of the flat pipe to be corroded is greatly reduced.

It should be understood that, alternately arranging the second fin 42 and the third fin 43 should be broadly understood, for example, in the direction X, from left to right, one second fin 42 may be followed by one third fin 43 or a plurality of third fins 43. Similarly, one third fin 43 may be followed by one second fin 42 or a plurality of second fins 42.

Figure 3:
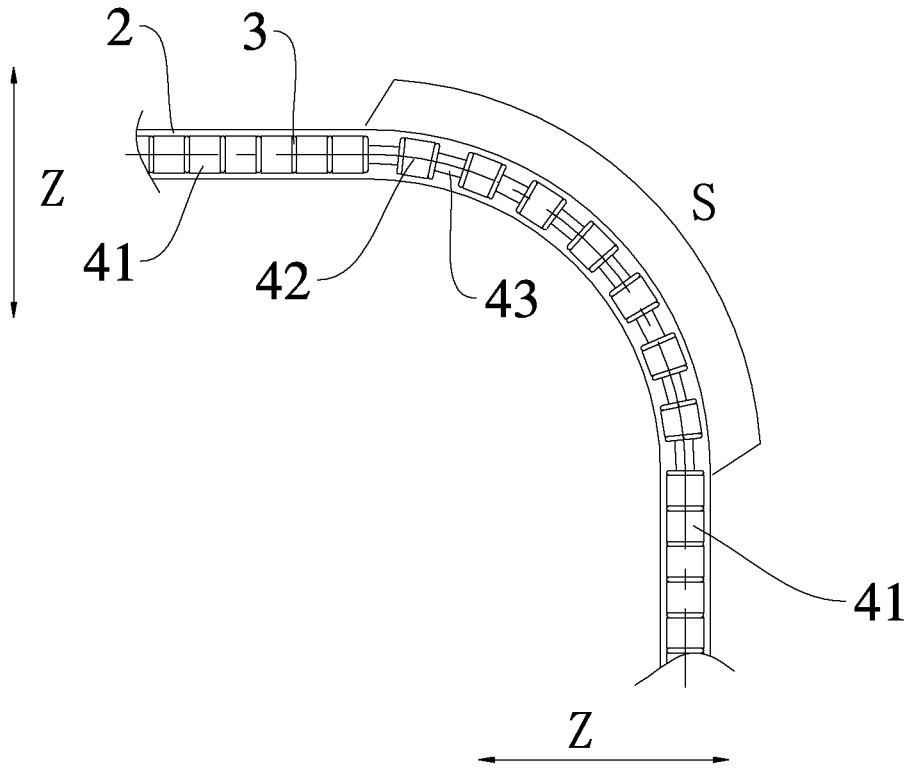
FIG. 3 is a partially top view of a heat exchanger according to an embodiment of the present disclosure, in which an upper header of the heat exchanger is removed and one bending segment is shown.

The heat exchanger according to a preferred embodiment of the present disclosure will be described below referring to FIG. 3 and FIG. 4. FIG. 3 is a partially top view of a heat exchanger according to an embodiment of the present disclosure, in which an upper header of the heat exchanger is removed and one bending segment is shown, and FIG. 4 is a schematic view of the bending segment shown in FIG. 3, in which the bending segment is unfolded.

Figure 4:
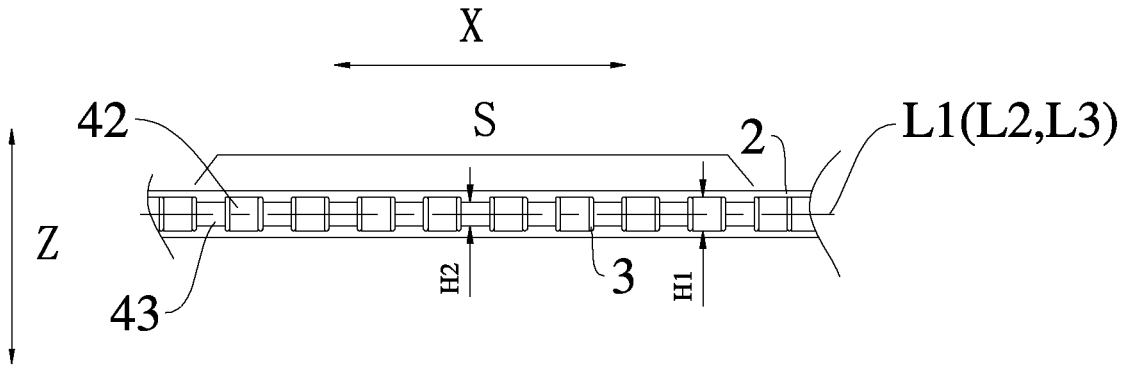
FIG. 4 is a schematic view of a bending segment shown in FIG. 3, in which the bending segment is unfolded.

As shown in FIG. 3 and FIG. 4, the second fin 42 and the third fin 43 are alternately arranged in such a manner that one second fin 42 is followed by one third fin 43. In other words, one second fin 42 is arranged as being followed by one third fin 43, and one third fin 43 is arranged as being followed by one second fin 42.

In an embodiment shown in FIG. 3 and FIG. 4, a centerline L2 of the second fin 42 extending in the thickness direction X of the flat pipe 3 and a centerline L3 of the third fin 43 extending in the thickness direction X of the flat pipe 3 coincide with each other in a plane (such as a horizontal plane shown in FIG. 1 and FIG. 2, a plane in FIG. 3 orthogonal to a sight line of an observer) orthogonal to the length direction Y of the flat pipe 3.

More preferably, a centerline L1 of the first fin 41 extending in the thickness direction of the flat pipe 3, the centerline L2 of the second fin 42 extending in the thickness direction of the flat pipe 3 and the centerline L3 of the third fin 43 extending in the thickness direction of the flat pipe 3 coincide with one another.

Certainly, the present disclosure is not limited to this. For example, the centerline L2 of the second fin 42 extending in the thickness direction X of the flat pipe 3 and the centerline L3 of the third fin 43 extending in the thickness direction X of the flat pipe 3 may be staggered with each other in the plane orthogonal to the length direction Y of the flat pipe 3. For example, in the plane orthogonal to the length direction Y of the flat pipe 3, the centerline L2 of the second fin 42 extending in the thickness direction X of the flat pipe 3 is located blow the centerline L1 of the first fin 41 extending in the thickness direction X of the flat pipe 3, and the centerline L3 of the third fin 43 extending in the thickness direction X of the flat pipe 3 is located above the centerline L1 of the first fin 41 extending in the thickness direction X of the flat pipe 3.

In an embodiment shown in FIG. 3 and FIG. 4, the width H1 of the second fin 42 is equal to a width of the first fin 41, and thereby both the width H1 of the second fin 42 and the width of the first fin 41 are larger than the width H2 of the third fin 43.

Figure 5:
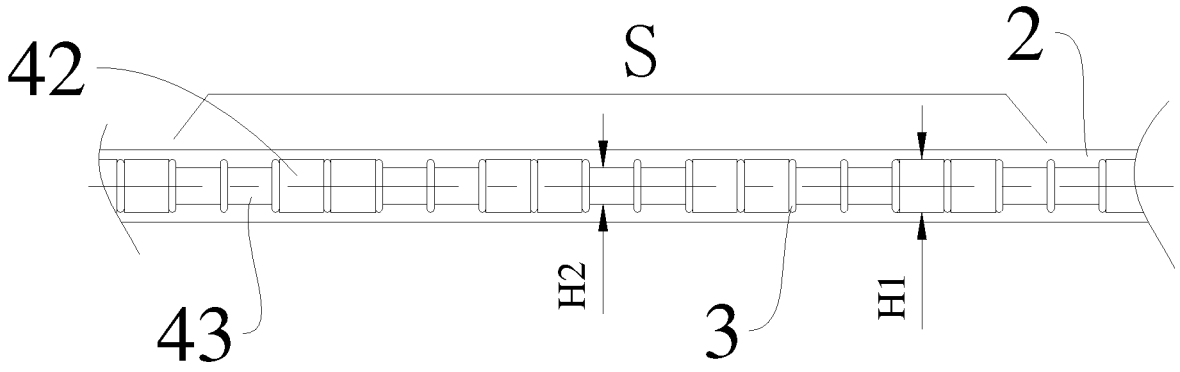
FIG. 5 is a schematic view of a bending segment of a heat exchanger according to another embodiment of the present disclosure, in which the bending segment is unfolded.

In an optional embodiment of the present disclosure, as shown in FIG. 5, the second fin 42 and the third fin 43 are alternately arranged in such a manner that two second fins 42 are followed by two third fins 43. In other words, two second fins 42 are arranged adjacent to each other, then two third fins 43 are arranged following the two second fins 42, and then another two second fins 42 are arranged following the two third fins 43.

Figure 6:
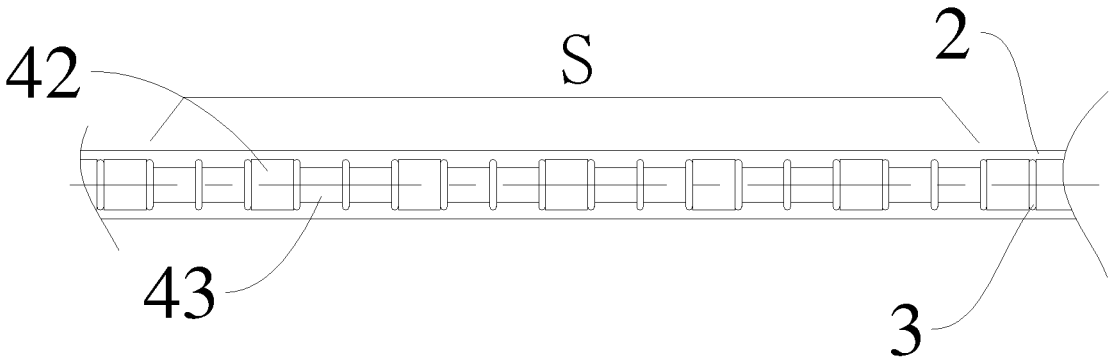
FIG. 6 is a schematic view of a bending segment of a heat exchanger according to another embodiment of the present disclosure, in which the bending segment is unfolded.

As shown in FIG. 6, optionally, the second fin 42 and the third fin 43 are alternately arranged in such a manner that one second fin 42 is followed by two third fins 43.

It may be understood that, a manner of alternately arranging the second fin 42 and the third fin 43 is not limited to above manners. For example, the second fin 42 and the third fin 43 may be alternately arranged in a combined one of the above manners.

In a preferred embodiment of the present disclosure, a ratio of the number of the second fins 42 to the number of the third fins 43 is in a range from 1/3 to 3.

In a preferred embodiment of the present disclosure, a ratio of a width of the flat pipe 3 to the width of the fin 4 is less than or equal to 2. More specifically, a ratio of the width of the second fin 42 to the width of the flat pipe 3 is larger than 0.75 and less than or equal to 1, and a ratio of the width of the third fin 43 to the width of the flat pipe 3 is less than or equal to 0.75.

More preferably, a ratio of the width of the third fin 43 to the width of the second fin 42 is larger than or equal to 0.4 and less than 1.

Through the above measures, the heat exchanging performance can be further improved, and the split and the compression deformation of the fin are reduced. Especially, the split and the serious compression deformation of the fin can be further avoided, when the ratio of the width of the flat pipe 3 to the width of the fin 4 is larger than or equal to 2 and the second fin 42 and the third fin 43 are alternately arranged in the direction X.

Figure 7:
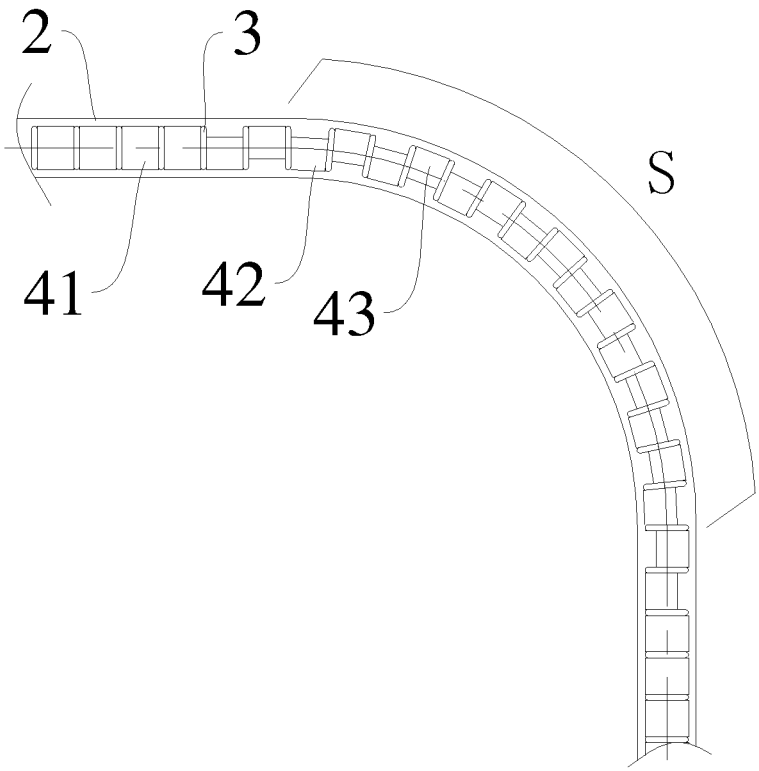
FIG. 7 is a partially top view of a heat exchanger according to another embodiment of the present disclosure, in which an upper header of the heat exchanger is removed and one bending segment is shown.
Figure 8:
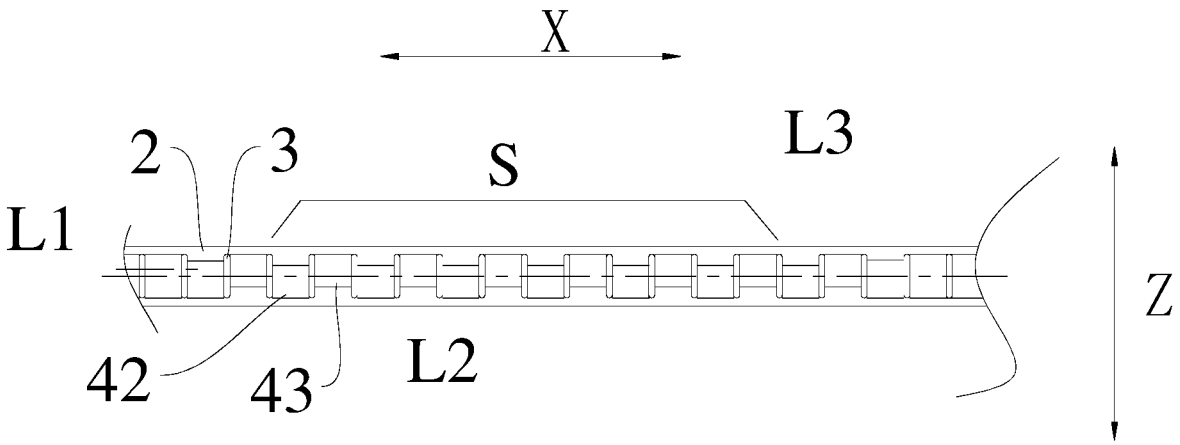
FIG. 8 is a schematic view of a bending segment shown in FIG. 7, in which the bending segment is unfolded.

In the following, a heat exchanger according to another embodiment of the present disclosure will be described with reference to FIGS. 1-2 and FIGS. 7-8. FIG. 7 is a partially top view of a heat exchanger according to another embodiment of the present disclosure, in which an upper header of the heat exchanger is removed and one bending segment is shown. FIG. 8 is a schematic view of the bending segment shown in FIG. 7, in which the bending segment is unfolded.

As shown in FIG. 7 and FIG. 8, with the heat exchanger according to this embodiment of the present disclosure, the centerline L2 of the second fin 42 extending in the thickness direction X of the flat pipe 3 and the centerline L3 of the third fin 43 extending in the thickness direction X of the flat pipe 3 are staggered with each other in the plane orthogonal to the length direction Y of the flat pipe 3.

With the heat exchanger according to an embodiment of the present disclosure, through staggering the centerline L2 of the second fin 42 extending in the thickness direction X of the flat pipe 3 with the centerline L3 of the third fin 43 extending in the thickness direction X of the flat pipe 3 in the plane orthogonal to the length direction Y of the flat pipe 3, the compression amount at the bent inner side and the elongation amount at the bent outer side of the fin located at the bending segment are both considered at the same time, such that the fin is not split at the bent outer side thereof and has a small compression deformation at the bent inner side thereof after the heat exchanger is bent, thus reducing the loss of the heat exchanging performance, and effectively avoiding the split and the serious compression deformation between the fin and flat pipe when the heat exchanger is bent.

In an embodiment shown in FIG. 7 and FIG. 8, the first fin 41, the second fin 42 and the third fin 43 have the same width. As described above, the second fin 42 and the third fin 43 may have different widths, and both of the widths are less than the width of the first fin 41.

A manner of arranging the second fin 42 and the third fin 43 may be the same with that described with reference to FIGS. 3-6, which will not be elaborated here.

In this embodiment of the present disclosure, preferably, a ratio of the number of the second fins 42 to the number of the third fins 43 is in a range from 1/3 to 3, and a ratio of a width of the flat pipe 3 to a width of the fin 4 is larger than 2.

More specifically, when the ratio of the width of the flat pipe 3 to the width of the fin 4 is larger than 2 and the centerline L2 of the second fin 42 extending in the thickness direction X of the flat pipe 3 and the centerline L3 of the third fin 43 extending in the thickness direction X of the flat pipe 3 are staggered with each other in the plane orthogonal to the length direction Y of the flat pipe 3, the split and the compression deformation of the fin are further avoided, thus further improving the heat exchanging efficiency.

With the heat exchanger according to embodiments of the present disclosure, the fin is not split at the bent outer side thereof and has a small compression deformation at the bent inner side thereof after the heat exchanger is bent, thus reducing the loss of the heat exchanging performance, and effectively avoiding the split and the serious compression deformation between the fin and the flat pipe when the heat exchanger is bent. Moreover, the fin is connected between adjacent flat pipes of the whole heat exchanger, thereby improving the heat exchanging effect, and there is no air loss and increased wind resistance, thus improving the performance. And, since the fin is connected between adjacent flat pipes, a probability of the flat pipe to be corroded is greatly reduced.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," "counterclockwise", "axial", "radial" and "circumferential" should be construed to refer to the orientation as then described or as shown in the drawings under discussion. These relative terms are for convenience of description and do not require that the present disclosure be constructed or operated in a particular orientation.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, "a plurality of" means two or more than two, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A heat exchanger, comprising:

a first header and a second header;

a plurality of flat pipes, each of the plurality of flat pipes defining a first end connected with the first header and a second end connected with the second header, and the plurality of flat pipes being arranged and spaced apart from each other in axial directions of the first header and the second header;

a plurality of fins, each of the plurality of fins being disposed between adjacent flat pipes, the plurality of fins comprising a first fin, a second fin and a third fin, wherein the heat exchanger has a bent segment and a straight segment adjacent to the bent segment, both the first header and the second header bent in the bent segment, both the first header and the second header extend in a straight manner in the straight segment, the first fin is in the straight segment, the second fin and the third fin are in the bent segment, and a centerline of the second fin extending in a thickness direction of the plurality of flat pipes and a centerline of the third fin extending in the thickness direction of the flat pipe extend along different lines in a plane orthogonal to a length direction of the plurality of flat pipes, the second fin and the third fin have different widths, both of the widths are less than the width of the first fin, the width of the fins extends in a direction parallel to a thickness direction of the heat exchanger.

2. The heat exchanger according to claim 1, wherein the second fin and the third fin are alternately arranged in at least one of following manners: one second fin being followed by one third fin, two second fins being followed by one third fin, one second fin being followed by two third fins, and two second fins being followed by two third fins.

3. The heat exchanger according to claim 1, wherein a ratio of a number of the second fin to a number of the third fin is in a range from 1/3 to 3.

4. The heat exchanger according to claim 1, wherein a ratio of a width of the plurality of flat pipes to a width of the plurality of fins is larger than 2.

5. The heat exchanger according to claim 1, wherein the heat exchanger has three bent segments and four straight segments.

6. A heat exchanger, comprising:

a first header and a second header;

a plurality of flat pipes, each of the plurality of flat pipes defining a first end connected with the first header and a second end connected with the second header, and the plurality of flat pipes being arranged and spaced apart from each other in axial directions of the first header and the second header;

a plurality of fins, each of the plurality of fins being disposed between adjacent flat pipes, the plurality of fins comprising a first fin, a second fin and a third fin, wherein the heat exchanger has a bent segment and a straight segment adjacent to the bent segment, the plurality of flat pipes located in the bent segment have an equal width, the first fin is in the straight segment, the second fin and the third fin are in the bent segment, and a centerline of the second fin extending in a thickness direction of the plurality of flat pipes and a centerline of the third fin extending in the thickness direction of the plurality of flat pipes extend along different lines in a plane orthogonal to a length direction of the flat pipe, the second fin and the third fin have different widths, both of the widths are less than the width of the first fin, the width of the fins extends in a direction parallel to a thickness direction of the heat exchanger.

* * * * *